US005317851A

United States Patent [19]

Lang et al.

[11] Patent Number: 5,317,851

[45] Date of Patent: Jun. 7, 1994

[54] PROCESS AND DEVICE FOR PACKING PRESSED BALES

[75] Inventors: Jürgen Lang, Gessertshausen; Herwig Hirschek, Bobingen, both of Fed. Rep. of Germany

[73] Assignee: Autefa Maschinenfabik GmbH, Friedberg, Fed. Rep. of Germany

[21] Appl. No.: 930,699

[22] PCT Filed: May 14, 1991

[86] PCT No.: PCT/EP91/00903

§ 371 Date: Sep. 29, 1992

§ 102(e) Date: Sep. 29, 1992

[87] PCT Pub. No.: WO91/17823

PCT Pub. Date: Nov. 28, 1991

[30] Foreign Application Priority Data

May 15, 1990 [DE] Fed. Rep. of Germany ..... 4015643

[51] Int. Cl.[5] ..... B65B 11/58; B65B 27/12

[52] U.S. Cl. ..... 53/379; 53/176; 53/449; 53/586; 53/589

[58] Field of Search ..... 53/176, 399, 438, 449, 53/529, 586, 589, 590, 210

[56] References Cited

U.S. PATENT DOCUMENTS 2,937,484 5/1960 Wiman ..... 53/176 X
4,499,709 2/1985 Miyano et al. ..... 53/589
5,125,210 6/1992 Lang et al. ..... 53/176 X

FOREIGN PATENT DOCUMENTS 0014923 9/1980 European Pat. Off. .
0029977 6/1987 European Pat. Off. .
0294820 12/1988 European Pat. Off. .
2948273 6/1981 Fed. Rep. of Germany .
3737020 12/1988 Fed. Rep. of Germany .
0199824 8/1989 Japan ..... 53/399

*Primary Examiner*—John Sipos
*Assistant Examiner*—Linda B. Johnson
*Attorney, Agent, or Firm*—McGlew and Tuttle

[57] ABSTRACT

The present invention pertains to a process and a device for packing pressed bales with a film and by strapping, wherein the pressed bale is maintained under pressure between pressure rams while the packing is applied. The packing device 1 has an enveloping device 5 and a strapping device 6, which are arranged on separately movable transport carriages 8, 9. The packing film is pulled off from a single film roll 10 on the other transport carriage 9 by means of a movable film arm 5 located on one of the transport carriage 8, and is placed in a U-shaped pattern as a belly bandage around the pressed bale 2. After cutting off from the roll 10, the film ends are then placed loosely over each other with an overlap by means of a second gripping arm 20, and fixed by strap hoops.

20 Claims, 5 Drawing Sheets

PROCESS AND DEVICE FOR PACKING PRESSED BALES

FIELD OF THE INVENTION

The present invention pertains to a process and a device for packing pressed bales and in particular to a processing device where a roll of film is moved on one carriage and a film arm is separately and independently moved on another carriage, and the film arm moves transversely to the travel direction of the carriages.

BACKGROUND OF THE PRESENT INVENTION

Such a process and the corresponding device have been know from EP 0,014,923. The enveloping device consists of two stationary brackets and two pivotable film arms here. The film arms are cantilevered at one end and carry, at the other end, the heavy film roll, as well as a welding and cutting device. The complete enveloping device is seated on a single transport carriage and is moved, at the level of the pressed bale, into the pressing or packing station from the side. During the traveling movement, the jacketing film, stretched between the stationary brackets and the film roll, is laid around the pressed bale, and the pivotable film arms perform an additional rotary movement with the film roll. Such an arrangement poses mechanical and kinematic problems.

The ends of the film are firmly connected at the junction point by welding, stapling, or in another manner. This is also necessary because the enveloping device must be detached from the pressed bale and be completely removed from the packing or press station for the subsequent strapping. It must make space for the independent strapping device. This technique is time-consuming and requires expensive design and control. Accommodating an enveloping device and a strapping device with their transport carriage separately from one another, maintaining them in the waiting position and having them move in and out separately is, last but not least, also a space problem. Therefore, the prior-art device cannot be used in all press systems, especially in so-called carrousel baling presses, in which the pressed bale is only poorly accessible from the side through the press columns. How the free end of the film is to be gripped and clamped for the next packing process after separation of the jacketing film and opening and withdrawal of the enveloping device is, furthermore, left open in the state of the art. The welding or stapling connection between the film ends also has proven to be unfavorable. Consequently, high-strength films with limited stretchability cannot be used for satisfactory packing.

SUMMARY AND OBJECTS OF THE PRESENT INVENTION

Therefore, the task of the present invention is to show a process and a device for packing pressed bales which can be used in any press system, are easy to handle, and permit better and more reliable packing.

The present invention accomplishes this task by having a film arm on a first carriage positioned on one lateral side of the bale. A roll of film is positioned on a second carriage on a second lateral side of the bale, and the second lateral side is substantially opposite the first lateral side. The carriages are movable in a travel direction and the film arm is movable with respect to the carriages in a transverse direction which is substantially perpendicular to the travel direction. The travel direction being substantially parallel to the lateral sides of the bale. The film arm extends laterally or transversely and grasps an end of the film from the film roll. The film arm then retracts to pull the film off of the film roll and the first carriage then moves in the travel direction to wrap the film around the bale. The second carriage also moves in the travel direction to cover the second lateral side with the film, and the film arm then extends traversely towards the second carriage to cover a front side of the bale. A gripping arm grasps a portion of the film adjacent the film roll, and a cutting means cuts the film between the film roll and the gripping arm. The gripping arm then moves the portion of the film towards the bale and a strapping means supplies straps around the bale and against the end of the film and the portion held by the gripping arm.

In the process according to the present invention, the heavy film roll can be moved in a simple manner, preferably over a straight path, along the pressed bale. The problems according to the present invention in terms of kinematics, mechanics, and the stability of the device can thus be avoided. The U-shaped enveloping movement of the jacketing film is performed by the easier-to-handle film arm, which can also be dimensioned as a relatively weak arm due to the low weight of the piece of film pulled off. Furthermore, the separation of the film roll and film arm and their independent mobility on separate transport carriages make it possible to solve the space problem. On the one hand, this makes it possible to arrange the packing device at any baling press, especially also carrousel presses, and also to retrofit it. As an alternative, use at independent packing stations, etc., is also possible.

On the other hand, strapping may take place immediately after the pressed bale has been enveloped. The strapping device may be combined with or directly follow the enveloping device. At any rate, the enveloping device does not have to be first removed, which is time-consuming and needlessly requires space, before the strapping device can come into action. The two devices may, instead, cooperate and complement each other functionally and in terms of the device, as a result of which the manufacturing costs are optimized.

It is recommended that the film ends be loosely overlapped and be fixed only by the strapping. The film ends may slide one over the other when the bale springs back and expands after the load has been released. The jacketing film is able to follow the stretching movement without breaking or without the packing undesirably opening in another manner. As a result, it is also possible to use high-strength packing films, whose strength would decrease due to the thermal effect during welding or stapling. According to the state of the art, this led to a weakening of the closed jacketing film at the junction point of the film ends. Thus, a rupture site was preprogrammed.

The enveloping device remains at the pressed bale during strapping and firmly holds the jacketing film. The taut and overlapped position of the film ends can thus be ensured. Furthermore, the packing time and the control effort are reduced. It is also favorable that only a simple rather than crosswise strapping of the pressed bale is necessary for fixing the film.

It is also advantageous in the packing technique according to the present invention that the process and the device are suitable for different bale sizes and are adaptable in terms of software. This broadens the range of use and at the same time reduces the expense of conversion.

The various features of novelty which characterize the invention are pointed out with particularity in the claims annexed to and forming a part of the disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERED EMBODIMENT

Figure 1:
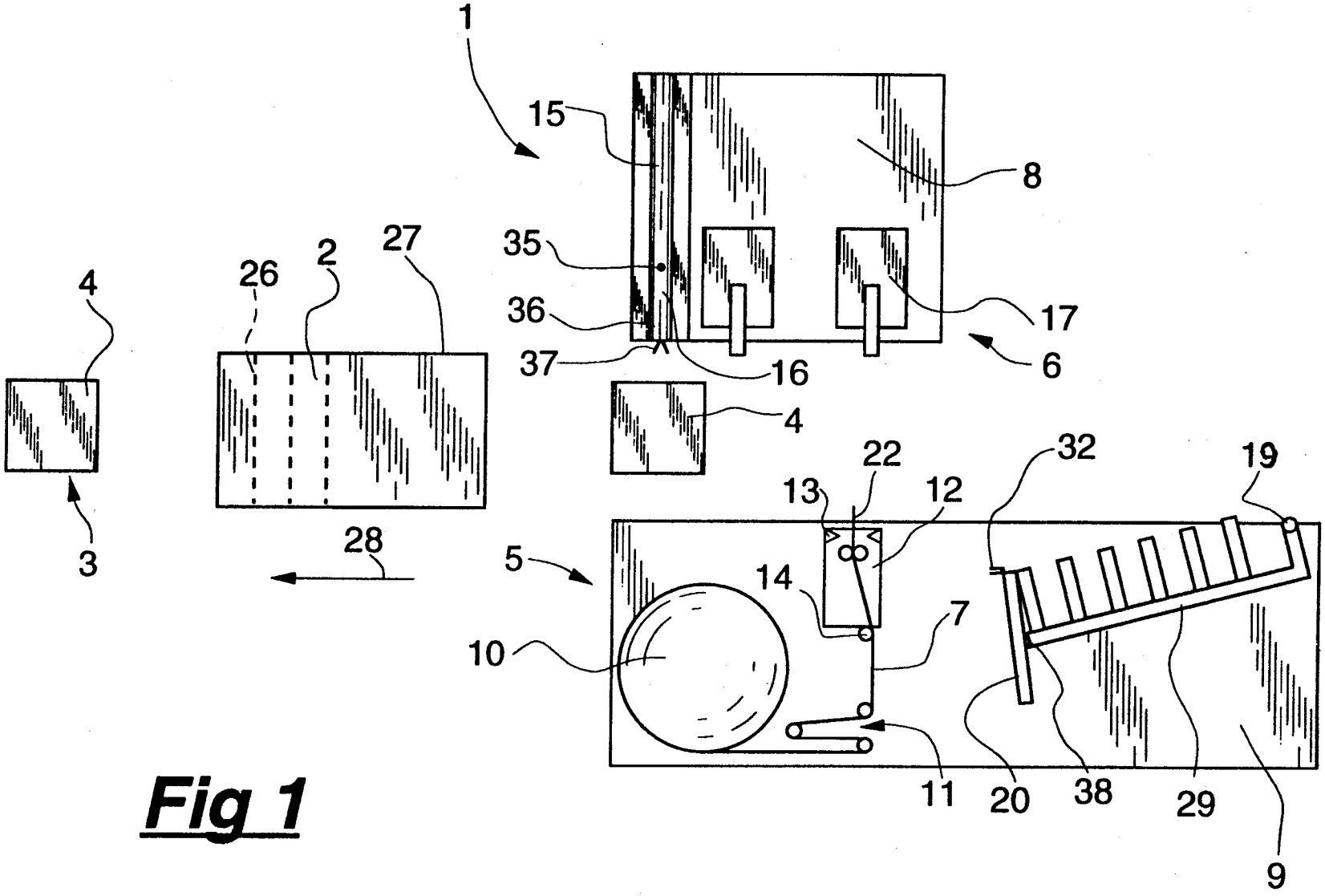
FIG. 1 shows a top view of a packing device at a baling press.
Figure 2:
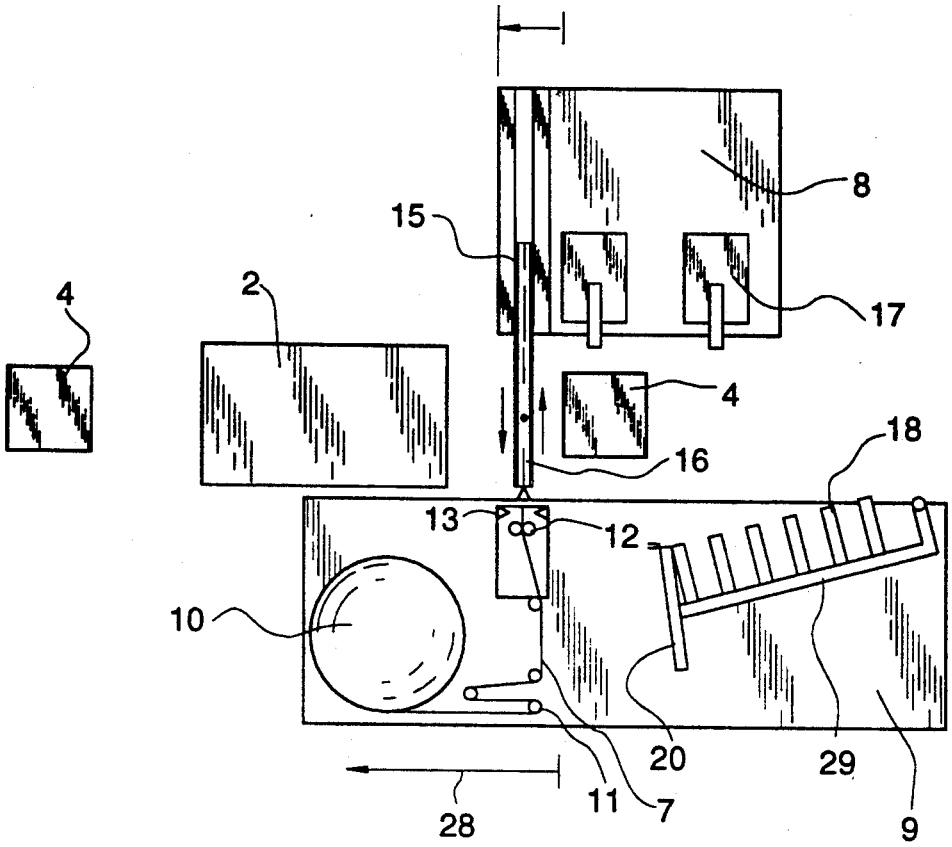
FIGS. 2–7 show the packing device according to FIG. 1 in different movement positions.

FIG. 1 shows a packing device 1 in conjunction with a baling press 3, here in the form of a known, double-sided carrousel baling press. Of the parts of the press, for clarity's sake, only the two vertical columns 4 of the press frame are shown. These are located at the finishing press station, in which the pressed bale 2 is maintained under pressure between two pressure rams 27. The pressed bale preferably consists of short or long cut textile fibers, the so-called tow. As an alternative, textile wastes or other materials may also be involved as bale materials.

FIG. 1 shows the embodiment in which the press box (not shown) has just been removed from the pressed bale 2. The packing device 1 is located outside the press chamber at this stage and approximately at the level of the outer press column 4.

The packing device 1 consists of an enveloping device 5 and a strapping device 6, both of which are arranged on two transport carriages 8, 9. The transport carriages 8, 9 are arranged movably on rails or other transit paths on both sides of and along the bale 2. They have independent drives and can be moved separately from one another. They move in the direction of travel 28 during the packing process.

The enveloping device 5 has a film roll 10 with a dancer roll 11 arranged after it, as well as a film feeding device 12 and a cutting device 13 arranged behind it. These are arranged together on the transport carriage 9. The enveloping device 5 also includes a gripping arm 20, which is arranged pivotably around a vertical axis 38, on a series arrangement of deflecting channels 18 of the strapping device 6. These parts are also arranged on the transport carriage 9. The enveloping device 5 also has telescoping holding pins 21 (cf. FIG. 6), which are also located on the transport carriage 9.

A film arm 15 of the enveloping device 5 with a front-end gripper 16 is arranged on the opposite transport carriage 8. Two strapping heads 17 of the strapping device 6 are located behind it in the direction of travel 28.

The rotatably mounted film roll 10, which is provided with guiding means for the jacketing film 7, is located at the front end of the transport carriage 9 when viewed in the direction of travel 28 and is slightly set back relative to the bale 2. The dancer roll 11 arranged after it forms a film storage means, in which the jacketing film 7 is wound over a plurality of vertical rolls which are elastically connected to one another. The dancer roll 11 equalizes the film tension and ensures uniform pulling off from the film roll 10.

Figure 4:
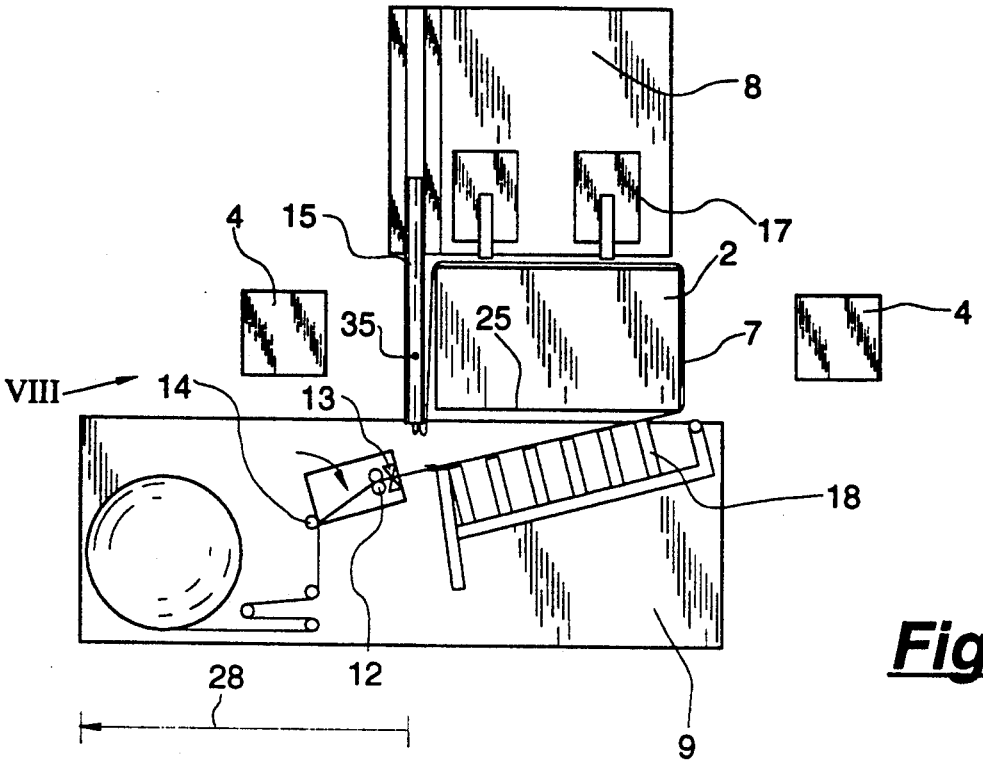

The jacketing film 7 subsequently enters the film feeding device 12, which has a feed and holding device, e.g., a friction wheel arrangement, which is able to pull the jacketing film from the film roll 10 and hold the end of the film. Directly behind it is located the cutting device 13, which may be designed as a cutter arrangement, a melting wire, or in another suitable manner. The cutting device 13 and the film feeding device 12 are located, in the direction of travel 28, behind the film roll 10 and are located directly at the bale-side edge of the transport carriage 9. They are arranged together on a support, which is rotatably mounted around a vertical pivot axis 14 on the transport carriage 9 (cf. FIG. 4).

The deflecting channels 18 are arranged at the rear end of the transport carriage 9 when viewed in the direction of travel 28. They are rotatably mounted around a vertical axis 19, which is at the rear end of the carriage and at the bale-side edge of the carriage. The number of the deflecting channels 18 present is at least equal to the number of tying grooves 26 in the pressure rams 27 and are arranged in a corresponding distributed pattern. The individual deflecting channels 18 are connected and held on the rear side by a frame 29, which in turn acts on the axis of rotation 19. In the resting position according to FIG. 1, the deflecting channels 18 are pivoted back from the bale-side edge of the carriage. The gripping arm 20 is located at the front frame end of the deflecting channels 18. It consists of a double arm arrangement, whose arm parts 30, 31 extend at right angles to the direction of travel 28 and are spaced from one another by more than the film height. The arm parts 30, 31 carry at their ends vertical and movable tensioning fingers 32, which are able to grip the horizontal edges of the film from above and from below, respectively. The tensioning fingers 32 themselves are adjustable in height.

The film arm 15 is mounted on the transport carriage 8 such that it can be extended at right angles to the direction of travel 28. It consists of a telescoping double arm arrangement, whose arm parts 33, 34 also extend at right angles to the direction of travel 28 and are spaced in height by less than the film height from one another. The gripper 16 is arranged at the arm ends pivotably around a vertical axis 35. It consists of two arm extensions 36, which carry, at their ends, horizontal tensioning fingers 37, which are able to grip and hold the vertical edge of the film.

FIGS. 2 through 7 show the course of the packing process. According to FIG. 2, both transport carriages 8, 9 first move slightly forward in the direction of travel 28 until the film arm 15 and the cutting device 13, as well as the film feeding device 12 assume a mutually flush position with one another between the press column 4 and the bale 2. The film arm 15 subsequently extends and grips, with its gripper 6 directed straight ahead, the front film end 22, which slightly projects over the cutting device 13. The film arm 15 subsequently returns to the starting position on the transport carriage 8, and pulls in the jacketing film 7.

Figure 3:
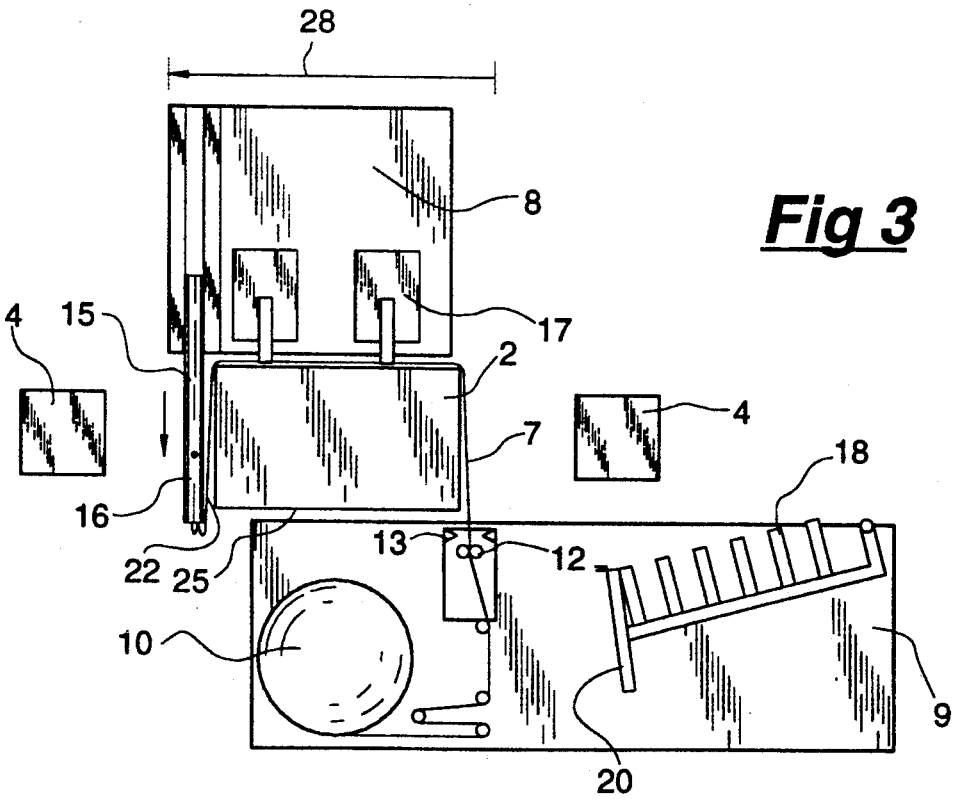

According to FIG. 3, the transport carriage 8 then continues to move forward until the film arm 15 is just in front of the bale 2. The film arm 15 then extends again to the extent that the hinge 35 of the gripper 16 is located approximately at the level of the opposite broad side 25 of the pressed bale 2. The other transport carriage 9 also moves slightly forward simultaneously and shortly thereafter, thereby placing the jacketing film 7 on the rear front of the bale.

The pressed bale 2 usually has an essentially rectangular cross-sectional shape and extends along the direction of travel 28. With the above-mentioned travel and extension movements, the jacketing film 7 is placed around the two small sides and one broad side of the pressed bale 2 in a lateral U-shape. The broad side 25 of the bale 2 facing the transport carriage 9 is now still open. To envelope the broad side 25 as well, the transport carriage 9 continues to move forward according to FIG. 4 until the axis of rotation 19 is located just behind the bale 2. Due to the pull on the film, the cutting device 13 and the film feeding device 12 automatically participate in the pivoting movement around their pivot axis 14, and then extend, together with the jacketing film 7, obliquely to the bale 2. In this position, they are located along the series arrangement of the deflecting channels 18, so that the tensioning fingers 32 of the gripping arm 20 are able to grip the upper and lower edges of the film. As soon as this has happened, the cutting device 13 comes into action and cuts through the jacketing film 7. The rear film end 23 is now held by the gripping arm 20.

Figure 5:
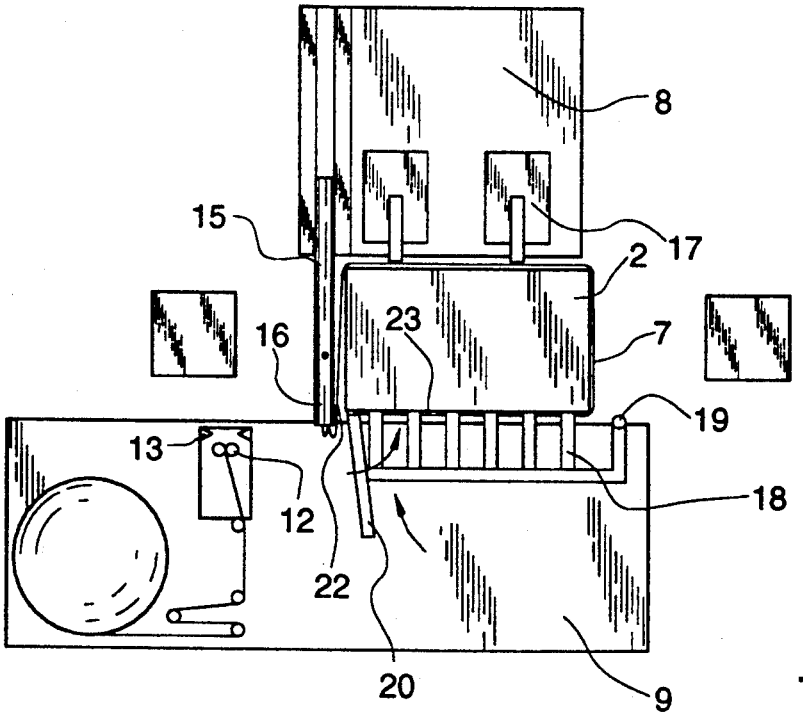

As is illustrated by FIG. 5, the deflecting channels 18 are now pivoted around their axis 19 to the pressed bale 2, and the jacketing film 7 is placed flatly on the broad side 25. The deflecting channels 18 are flush with the tying grooves 26 and already securely assume their strapping position. They will then remain immobile during the strapping process. The gripping arm 20 comes to lie at the front corner of the bale due to the pivoting movement of the frame 29. The jacketing film 7 and the rear film end 23 are now placed over and held on the lateral surface 25 while pulling. The gripper 16 is subsequently actuated, and it folds onto the lateral surface 25 while carrying with it the front film edge 22. It now moves through the free space within the bent deflecting channels 18 and under the gripping arm 20, and it places, under tension, the front film end 22 over the rear end 23 of the film.

Figure 6:
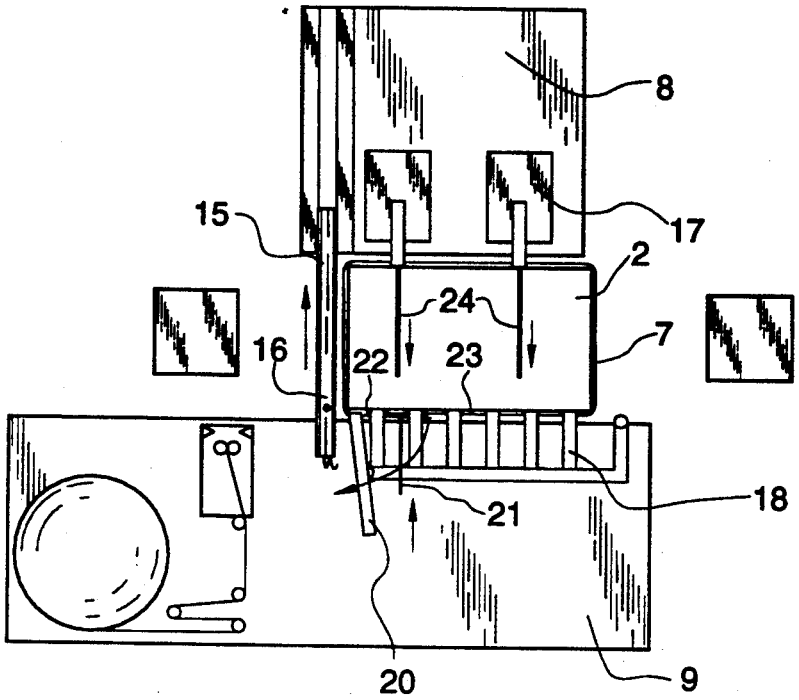

According to FIG. 6, two or more holding pins 21 now extend and press the front film end 22 onto the lateral surface 25. The gripper 16 can now release the front end 22 of the film and pivot back into the straight position relative to the film arm 15, which will then again withdraw. The first two strap hoops 24 are applied in this position by the two strapping heads 17 arranged behind the film arm 15. At least one strap hoop is now placed over the overlapped film ends 22, 23 and fixes same.

Figure 7:
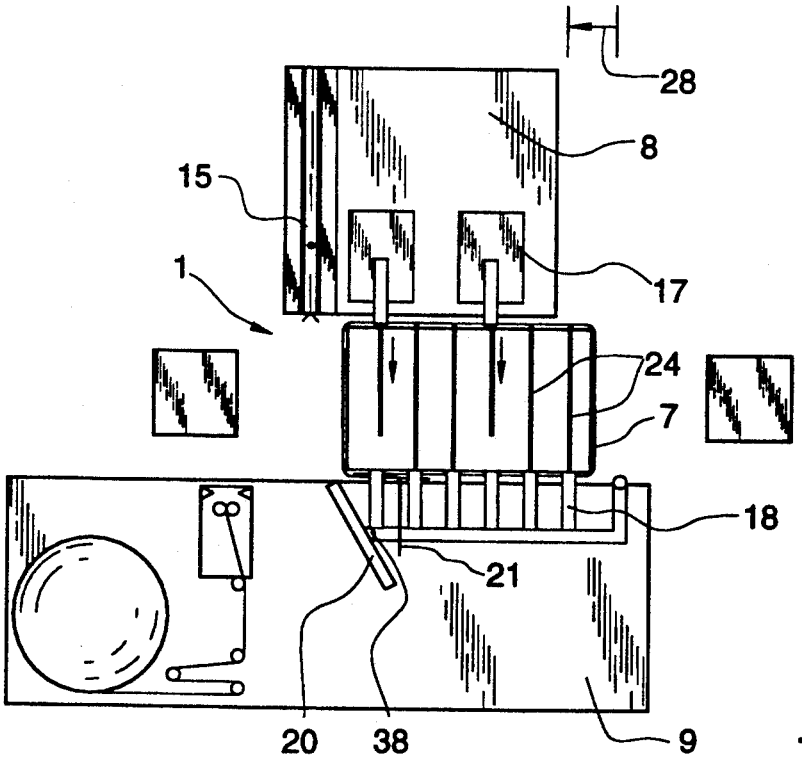
Figure 8:
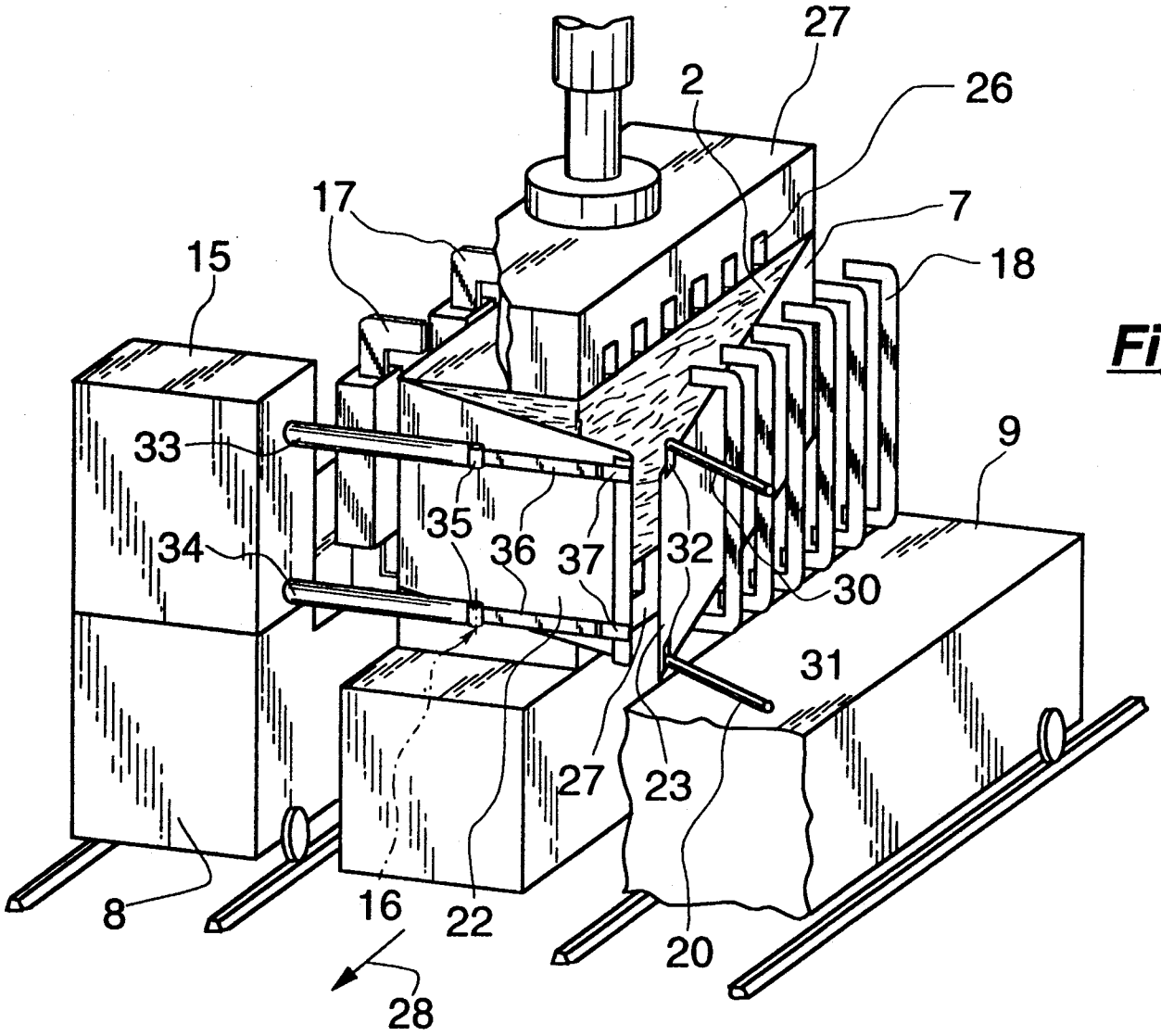
FIG. 8 shows a perspective front view of the packing device according to arrow VIII in accordance with in FIG. 4.

According to FIG. 7, the transport carriage 8, with the film arm 15 withdrawn, proceeds further by the distance of the tying groove, and applies the remaining strap hoops 24. The said transport carriage 9 remains immobile with the deflecting channels 18. During strapping, the film ends 22, 23 are also held by the gripping arm 20 and the holding pins 21. On conclusion of the strapping, the pressure rams 27 are disengaged, as a result of which the pressed bale 2 expands and springs into the strap hoops 24. The holding pins 21 and the gripping arm 20 are separated from the film ends 22, 23 and move and pivot back, respectively. To achieve this, the tensioning fingers 32 of the gripping arm 20 are first pulled off from the film edge in the upward and downward directions, respectively. The deflecting channels 18 then again fold back into the starting position according to FIG. 1, and the press bale 2 can be removed on return of the transport carriages 8, 9. In the starting position according to FIG. 1, the finishing press station of the baling press 2 can be charged with new material, and the cover films for the upper and lower faces of the bale can also be applied and placed over them. The film feeding device 12 has meanwhile also moved the front end 22 of the new film slightly beyond the opened cutting device 13, so that it can again be gripped by the film arm 15 during the next packing process.

While specific embodiments of the invention have been shown and described in detail to illustrate the application of the principles of the invention, it will be understood that the invention may be embodied otherwise without departing from such principles.

What is claimed is:

1. A process for packing pressed bales, the process comprising the steps of:

providing a film arm on a first lateral side of the bale;

providing a roll of film on a second lateral side of the bale, said second lateral side being substantially opposite said first lateral side;

grasping an end of said film with said film arm;

moving said film arm with said grasped end of said film in a U-shaped movement along a third side of the bale, along said first lateral side of the bale, and along a fourth side of the bale to pull said film off of said roll and wrap said film around the bale;

separately moving said roll from said film arm along said second lateral side of the bale to meet the film arm with said grasped end of said film and complete the wrap.

2. A process in accordance with claim 1, wherein:

said roll is stationary with respect to the bale during said pulling off of said film by said film arm;

said separately moving of said roll is performed after said moving of said film arm.

3. A process in accordance with claim 1, wherein:

said separately moving of said roll is in a substantially straight path in a travel direction, said travel direction being substantially parallel to said first and second lateral sides;

said moving of said film arm in said U-shaped movement having a substantially straight component in said travel direction, and also transverse movements substantially perpendicular to said travel direction, said transverse movements being performed at front and rear sides of the bale with respect to said travel direction.

4. A process in accordance with claim 1, further comprising:

providing a first transport carriage means on said first lateral side of the bale and for moving said film arm in a travel direction of said U-shaped movement independently of said moving of said roll;

providing a second transport carriage means on said second lateral side of the bale and for moving said roll in said travel direction independently of said moving of said film arm.

5. A process in accordance with claim 1, further comprising:

said film arm holding said end of said film against the bale;

strapping said bale with a strap against said end of said film while said film arm is holding said end of said film against the bale.

6. A process in accordance with claim 1, further comprising:

said film arm projecting said end of said film over said second lateral side of the bale at a completion of said U-shaped movement;

cutting said pulled off film to create another end;

placing said another end of said film against said second lateral side;

folding said end of said film over said another end of said film.

7. A process in accordance with claim 5, wherein:

said film end is maintained under tension until said strapping.

8. A process in accordance with claim 1, wherein:

said U-shaped movement of said film arm includes extending said film arm from said first lateral side to said roll for said grasping of said end of film, said extending of said film arm being in a transverse direction substantially perpendicular to said first and second lateral sides;

said U-shaped movement of said film arm also includes withdrawing said film arm to said first lateral side after said grasping of said end of said film;

said U-shaped movement of said film arm also includes moving said film arm in a travel direction independently of said moving of said roll, said travel direction being substantially perpendicular to said first and second lateral sides;

said U-shaped movement of said film arm also includes extending said film arm from said first lateral side, after said moving in said travel direction, to said second lateral side;

providing a gripping arm adjacent said roll and movable in said travel direction with said roll;

grasping said pulled off film with said gripping arm;

cutting said pulled off film to create another end;

moving said gripping arm to place said another end of said film against said second lateral side;

moving said film arm to place said end of said film against the bale;

strapping said end of said film and said another end of said film to the bale while said gripping arm and said film arm place said end and said another end of said film against the bale, said gripper means and said film arm pulling said film off of said roll and around the bale when said film arm is moved in said transverse direction away from said bale and also in said travel direction.

9. A device for packing pressed bales, the device comprising:

a first transport carriage positioned on a first lateral side of the bale and movable in a travel direction, said travel direction being substantially parallel with said first lateral side;

a second transport carriage positioned on a second lateral side of the bale and movable in said travel direction independently of said first transport carriage, said second lateral side being substantially opposite said first lateral side;

a roll of film positioned on said second transport carriage;

a film arm positioned on said first transport carriage, said film arm being movable in a transverse direction toward said second transport carriage and substantially perpendicular to said travel direction, said film arm including gripper means for grasping an end of said film from said roll when said film arm is moved toward said second transport carriage and means for moving said first carriage and said second carriage in said travel direction and means for moving said film arm in said transverse direction toward and away from said second carriage to move the film arm with a grasped end of said film in a U-shaped movement along a third side of the bale, said first lateral side and a fourth side of the bale.

10. A device in accordance with claim 9, wherein:

said gripper means is pivotably connected to an end of said film arm.

11. A device in accordance with claim 9, further comprising:

strapping means positioned on said first and second transport carriages and for strapping said film around the bale while said film arm and said roll are adjacent the bale.

12. A device in accordance with claim 9, wherein:

said strapping means includes a strapping head positioned on said first transport carriage.

13. A device in accordance with claim 9, further comprising:

a dancer roll positioned on said second transport carriage;

a film feeding means for feeding said film from said roll and positioned on said second transport carriage;

cutting means positioned on said second transport carriage and for cutting said film.

14. A device in accordance with claim 13, wherein:

said cutting means is pivotably mounted on said second transport carriage about an axis substantially parallel to said film.

15. A device in accordance with claim 11 wherein:

said strapping means includes a frame pivotably mounted on said second transport carriage about an axis substantially parallel with said film, said frame including a plurality of deflecting channels.

16. A device in accordance with claim 15, wherein:

said frame of said strapping means has a movable gripping arm means for grasping said film and moving the grasped film against the bale.

17. A device in accordance with claim 12, wherein:

said strapping head is arranged on a rearward side of said film arm with respect to said travel direction.

18. A device in accordance with claim 15, wherein:

said frame of said strapping means is arranged on a rearward side of said roll with respect to said travel direction.

19. A device in accordance with claim 9, further comprising:

a holding pin movably mounted on said second transport carriage and movable against said film toward the bale.

20. A device in accordance with claim 9, further comprising:

cutting means positioned on said second transport carriage and for cutting said film to form another end;

strapping means positioned on said first and second transport carriages and for strapping said film around the bale while said film arm and said roll are adjacent the bale, said strapping means includes a frame pivotably mounted on said second transport carriage about an axis substantially parallel with said film, said frame of said strapping means has a movable gripping arm means for grasping said another end of said film and moving said another end of said film against the bale, said strapping means strapping a strap around the bale and against said end and said another end while said gripping arm means is adjacent the bale.

* * * * *